United States Patent [19]

Clevenger

[11] 3,974,633

[45] Aug. 17, 1976

[54] NOISE ISOLATION MOUNTING MEANS FOR TAPE TENSIONER ASSEMBLY OF A TEXTILE YARN TWISTER

[75] Inventor: Earl C. Clevenger, Clemson, S.C.

[73] Assignee: Platt Saco Lowell Corporation, Easley, S.C.

[22] Filed: Oct. 6, 1975

[21] Appl. No.: 619,827

[52] U.S. Cl. ..... 57/1 R; 57/105; 57/136

[51] Int. Cl.[2] ..... D01H 1/24; D01H 1/16

[58] Field of Search ..... 57/1 R, 34 R, 104, 105, 57/136, 137; 248/20, 22

[56] References Cited

UNITED STATES PATENTS

| | | | |
|---|---|---|---|
| 2,758,439 | 8/1956 | Bradshaw | 57/1 R X |
| 3,054,250 | 9/1962 | Schurr et al. | 57/104 |
| 3,060,673 | 10/1962 | Anderson et al. | 57/105 |
| 3,604,191 | 9/1971 | Jaeggli | 57/1 R |
| 3,641,757 | 2/1972 | Rehn | 57/105 X |
| 3,946,545 | 3/1976 | Pray | 57/1 R |

*Primary Examiner*—John Petrakes
*Attorney, Agent, or Firm*—Donald H. Feldman

[57] ABSTRACT

In a textile yarn twister, means for mounting idler pulleys and the drive tape tensioner spring transversely across the width of the twister between its opposing spindle rails resiliently. The pulleys are rigidly supported by and are interconnected with a transverse beam positioned between a pair of opposing spindle assemblies, the beam being vertically interconnected with each of the spindle rails by a resilient, vibration damping, isolation mount. Shock absorber elements are horizontally interposed between the transverse beam and the spindle rails to prevent shearing of the isolation mounts upon start-up or stoppage of the twister. Adjacent transverse beams are rigidly interconnected by elongate rigid members spaced away from the spindle rails to provide, in all, transverse and longitudinal stability of a plurality of the present mounting means relative the spindle assemblies associated therewith.

9 Claims, 1 Drawing Figure

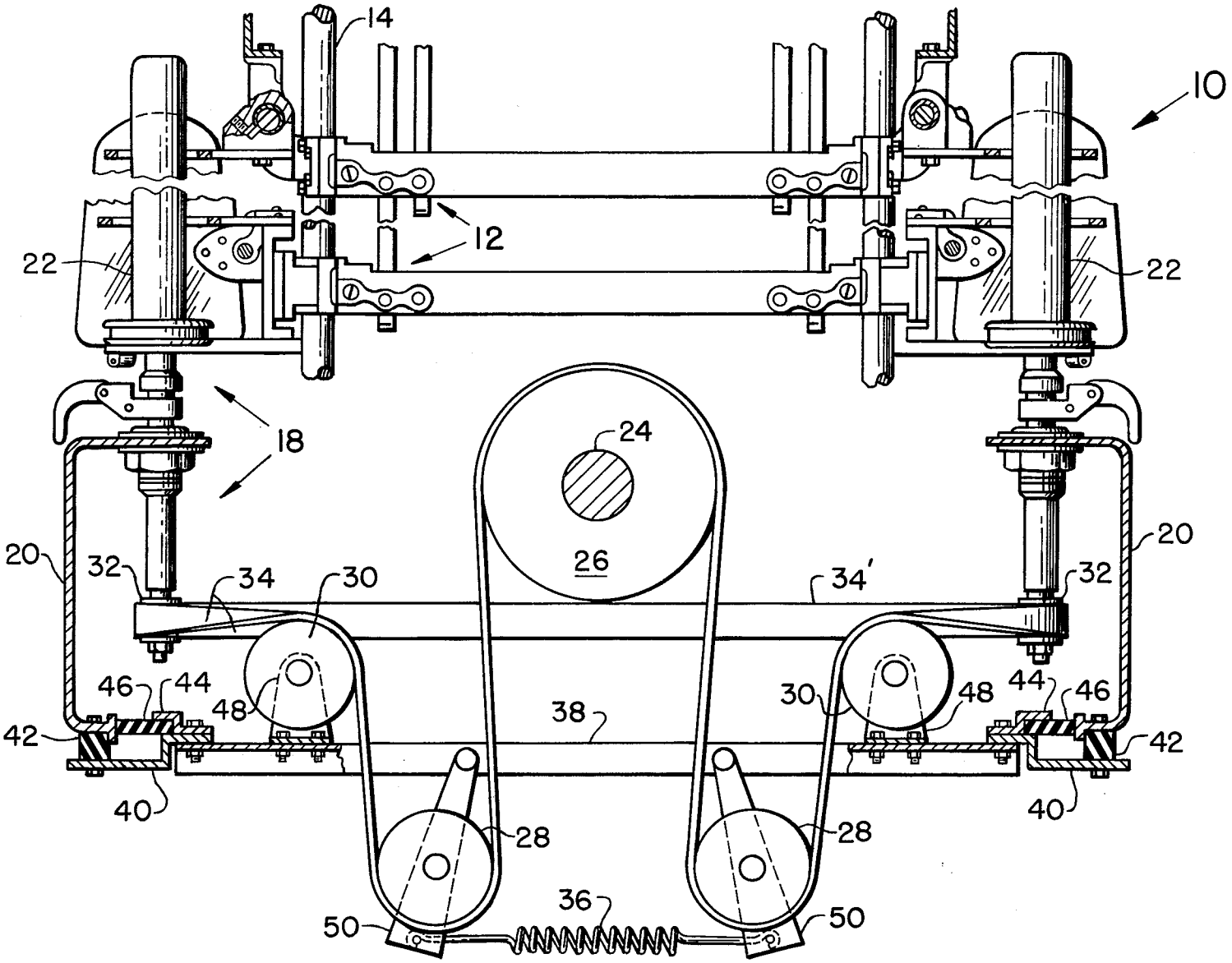
10
22
20
42
32
46
44
40
48
34'
30
28
50
24
26
38
36
12
14
18
34
22
20
42

NOISE ISOLATION MOUNTING MEANS FOR TAPE TENSIONER ASSEMBLY OF A TEXTILE YARN TWISTER

BACKGROUND OF THE INVENTION

This invention relates to a mounting means for the tape tensioner assembly of a spindle drive means for textile yarn twister machines, and more particularly relates to such a mounting means which effectively damps and isolates noise generating vibrations, issuing from said tape tensioner assembly, from both the spindle rails and the frame of such machines.

With the recognition that, in textile mill operations, textile machinery emitted noise levels which may affect the aural acuity of machine operators adversely, and with the passage of laws prescribing the maximum levels of noise which are allowable in industry, machinery design engineers set about identifying the sources of sound emission from such machines. Prior to the advent of this invention, it was not recognized that, in textile twisters, an important noise generating source during machine operation was not only the spindle drive means but its attendant drive tape and idler pulleys, the latter placed under tension to permit a smooth and undiminished transmission of power to the spindles to rotate the same. The portion of the spindle drive means containing the idler pulleys with wraps of drive tape thereabout and the mounting means for such idler pulleys and the means for imparting tension thereto and thus to the drive tape is known as a tape tensioner assembly. Further, it was not recognized that the primary noise generator of the spindle drive means was the tape tensioner assembly.

In the prior art, as disclosed in U.S. Pat. No. 3,604,191, attempts were made to isolate noise generating vibrations issuing from the plurality of spindle assemblies and that portion of the spindle drive means therefor, wherein the drive tapes made running contact with the spindle whirls to rotatively drive them, which extended in rows on either longitudinal side of the twister. These attempts included isolating the longitudinal spindle rails upon which said rows of spindle assemblies are mounted from frame members of the twister, which latter can act to amplify the vibrations to impermissible sound levels, by means of resilient noise isolation mounts, and from the ambient environment by means of enclosing sound abatement shields about portions of the spindle assemblies including the ring and traveler and the whirl, and that portion of the driving tape proximal the spindle whirl.

Prior to the aforesaid recognition of the importance of noise abatement, textile twister machines were designed for efficiency of operation, a typical one of which is disclosed in U.S. Pat. No. 3,060,673 which provides insight into prior art tape tensioner assemblies.

OBJECTS OF THE INVENTION

It is an object of the invention to provide a mounting means for substantially isolating noise generating vibrations issuing from the tape tension pulley wheels and their contacting drive tapes from transmission to other members of a twister textile machine to provide noise abatement.

Another object of the invention is to provide such a mounting means which imparts stability longitudinal and transversely the twister.

These and other desirable objects of the invention shall be apparent from and/or inherent in the descriptions and explanations which follow.

SUMMARY OF THE INVENTION

The means used to rotatively drive spindles of a twister textile machine generally includes a drive shaft from a motor, a drive drum positioned on the drive shaft intermediate the width of the twister frame between a pair of spindle assemblies on opposite longitudinal sides of the twister, a drive tape interconnecting the drum with the whirls of the pair of spindle assemblies through and about a plurality of idler pulley wheels spaced between the drum and the respective whirls, and a mounting means to support the pulley wheels for free rotation and to impart a force therebetween to maintain the drive tape in tension.

The present mounting means for a tape tensioner assembly of the spindle drive means of a twister comprises transverse support means, for said plurality of idler pulley wheels, vertically interconnected with the spindle rails extending each on opposite longitudinal sides of the twister by means of resilient, vibration damping isolators, and longitudinal support means for a plurality of transverse support means comprising a rigid member rigidly fixed to each and joining the plurality of said longitudinal support means and generally extending in a direction longitudinal the twister frame. The transverse support means includes a further resilient member in transverse abutting contact with each of said spindle rails.

THE DRAWING

A better understanding of the nature of the invention may be had from the following description of a preferred embodiment thereof taken in conjunction with the appended drawing in which:

The FIGURE shows a twister frame and the tape tensioner assembly's mounting means of the invention in side elevation and and in section taken adjacent to one of the plurality of said mounting means on a textile yarn twister machine.

PREFERRED EMBODIMENT

With reference to the FIGURE, a portion of an otherwise conventional textile yarn twister, generally designated 10, is shown with its reciprocatory members, generally designated 12, which vertically traverse on support rods 14, which form a portion of the supportive frame of twister 10, in order to build packages of yarn being wound on spindle assemblies designated 18. Assemblies 18 are arranged in longitudinally extending rows (not shown) on opposite sides of twister 10, being mounted upon opposing spindle rails 20 which rails 20, in turn, are securely mounted upon other portions of the supportive frame (not shown) of twister 10. Such mounting may be rigid, as is most commonly used in present day twisters, or be of a resilient nature such as is disclosed by Jaeggli in the aforesaid U.S. Pat. No. 3,604,191. Rails 20 may accomodate, in spaced apart relation along their lengths, as many as 50 or more spindle assemblies 18 on each side of twister 10, and such assemblies 18 on each rail 20 directly oppose the assemblies on the other rail, so that an opposing pair of assemblies 18 and their interconnections as shown are representative of the plurality of paired sets extending throughout the longitudinal length of twister 10.

In order to rotate the spindles 22 of assemblies 18 to build yarn packages, a drive means is provided and comprises a drive shaft 24 interconnected with a drive motor (not shown), which shaft 24 extends the longitudinal length of twister 10; at points along the length of shaft 24 which are intermediate an opposing pair of spindle assemblies 18, shaft 24 is fitted with a driving drum 26; further, intermediate assembly 18 of an opposing pair and drum 26 are mounted a plurality of freely rotatable idler pulleys 28 and 30; the drive means further comprises the spindle whirl 32 of assembly 18 which is interconnected with spindle 22 for concurrent rotation of the two, and a drive tape 34 for interconnecting whirls 32 with driving drum 26 by entrainment about peripheral surfaces of whirls 32, idlers 28 and 30 and drum 26 under tension.

All of the foregoing is known in the prior art, in so far as the types of elements involved and the above description of their interconnections.

Idler pulleys 28 and 30 are provided to change the direction of tape 34 so that power from shaft 24 may be transmitted to whirls 32 and thus spindles 22 without any substantial loss, and also to provide a means of imparting sufficient tension to tape 34 so that loss of power due to tape slippage at the entrainment surfaces of the aforesaid elements 26, 28, 30 and 32 is neglible, the aforesaid including any slackening of tape 34 on either side of drum 26 which might otherwise occur upon the start-up or stoppage of twister 10 and the concommitant application and stoppage of power by the drive motor aforesaid. Thus, tape 34 is wound in serpentine fashion as shown about the aforesaid peripheral entrainment surfaces, and opposing idler pulley wheels 28 are resiliently biased by means of a spring element 36 to impart the desired tension to tape 34.

Herein a resilient mounting means is provided for the drive tape tensioner assembly comprising pulley wheels 28 and 30 and spring 36. The mounting means comprises a resilient transverse support means for providing support of the elements of the mounting means transversely across the withwise direction of twister 10, and rigid longitudinal support means for providing support of each and the plurality of the mounting means across the longitudinal length direction of twister 10.

The present transverse support means comprises an elongate rigid supportive member 38 extending below drive drum 26 and the portion 34' of drive tape 34 directly joining opposing whirls 32 and extending across the width of twister 10; a rigid member 40 rigidly joined to each end of support member 38 and extending therebeyond to a position proximal and spaced away from the respective spindle rail 20, and a resilient vibration isolation mount member 42 rigidly fixed to said spindle rail 20 and said rigid member 40 at said proximal position thereof to join the two resiliently in the vertical direction; a rigid holding member 44 rigidly fixed at each end of said elongate supportive member 38; and a resilient shock absorbing member 46 positioned in abutting relation to said holding member 44 and to said spindle rail 20.

With more particular reference to the FIGURE, elongate rigid supportive member 38 is show, partially cut away and in section, to be a channeled beam of structural metal. Rigidly fixed to beam 38 and supported thereby are the aforesaid members 40 and 44, and mounting stands 48 by means of bolts (unnumbered). Also rigidly and pivotally joined to beam 38 intermediate stands 48 along the beam are swing arms 50. Idler pulley wheels 30 are rotatively mounted on stands 48, and idler pulleys 28 are rotatively mounted on swing arms 50 at a point intermediate the ends of said swing arms. Spring 36, in turn, is fixed at each end to each of swing arms 50. Thus, the resilient force imparted by spring 36 to arms 50 and their interconnected pulley wheels 28 imparts the aforesaid desired tension to tape 34 entrained about wheels 28. Rigid member 40 is bent to a contour to provide a spaced away adjaceny to spindle rail 20 sufficient to accomodate therebetween resilient vibration isolation mount member 42, which latter is shown to be formed of rubber and bolted at its top and bottom to rail 20 and member 40, such bolts (unnumbered) being separated within the body of mount member 42 by rubber. Vibration isolation mounts, such as mount member 42, are well known in the art of noise abatement. The aforesaid assemblage, in all, provides substantial and resilient support for the drive tape tensioning assembly and its components in the transverse or widthwise direction of twister 10, as well as substantial isolation of any noise generating vibrations which may be generated at or proximal the contacting surfaces of tape 34 and idler pulley wheels 28 and 30 from transmission to spindle rail 20, which at its large surface areas may otherwise amplify such vibrations and the consequent sound levels, and also from any frame members which may be interconnected with rail 20 and act in a similar manner to amplify sound levels.

The present rigid longitudinal support means comprises a plurality of elongate rigid members rigidly joined to each and the plurality of the elongate rigid supportive members of the various ones and plurality of transverse support means used in the twister. Such elongate rigid longitudinal members extend in a direction generally longitudinal the twister. Here, it is to be understood that such members may join together as few as two transverse support means.

With more particular reference to the FIGURE, in this preferred embodiment the elongate rigid members of the longitudinal support means are shown to be the aforesaid rigid members 40. Members 40 are proximately Z-shaped beams of structural metal rigidly joined to beam 38 at either end thereof as previously recited, and to at least one other beam 38 (not shown) of another transverse support means of another drive tape tensioner assembly longitudinally spaced from that shown and intermediate the next pair of spindle assemblies on the twister 10. Thus, in this embodiment, beams 40 serve the dual purpose of providing longitudinal support and positional stability to the present transverse support means of the invention and also act to conjoin elongate transverse support beam 38 with resilient isolation mounts 42 to serve in this way as components of the present transverse support means. Rigid members 40, however, in other embodiments may be delimited in function to conjoin mounts 40 to beam 38 and be in the form of mere "angle irons." Alternately, in yet other embodiments, support beam 38 may have mounts 42 rigidly joined thereto directly, eliminating rigid members 40 from the construction. In these other embodiments, the present longitudinal support means would comprise rigid elongate members rigidly fixed at spaced intervals along and to transverse beam 38 to impart the desired longitudinal support and positional stability to each and a plurality of the present transverse support means.

In the practice of this invention, while the present vibration isolation mount members have been shown and been described as being formed in the main of rubber, one may use in their stead springs of suitable spring constants; alternately, one also may use suitable springs in place of the rubber shock absorbing elements 46 or pneumatic or hydraulic shock absorbing cylinders, all well known in the art as suitable for such purpose of minimizing movement and providing positional stability. In the present instance, it is discovered that the need for minimizing movement of the transverse support means and restoring it to a stable positional state is accentuated when one employs rubber isolation mount members 42, since without shock absorbing members such as elements 46, changes in transmitted power by belt 34 upon start-up or stoppage of twister 10 are great enough to cause the present transverse mounting means to be displaced in the widthwise direction of twister 10 sufficient to exceed the elastic limits of resilient isolation mounts 42 and shear them. Here, it must be remembered that such changes on start-up and stoppage are quite sudden and of high magnitude.

Comparison tests were made between a prior art mounting means and one of this invention as shown in the FIGURE to determine the possible differences in sound emissions produced. Using an otherwise conventional twister machine, having 24 pairs of opposing spindle assemblies mounted upon spindle rails as in the FIGURE, a 20 horsepower motor running at 1,800 revolutions per minute, a drive shaft extending therefrom running at 1,400 rpm, the tape driven idler pulley wheels rotating at speeds of 4,600 rpm and the spindles driven at rotational speeds of 5,600 rpm, sound level measurements were made. In the prior art mounting means, beam 38 of the FIGURE was long enough to underextend the respective lower horizontally disposed flanges of spindle rails 20, and directly bolted thereto to form rigid connections devoid of any of the aforesaid resilient members above described. The sound level measurements covered the third octave central frequencies of sound vibration from 63 through 16,000 Hertz to provide overall sound levels as measured in decibels on the A weighted scale (dBA) of 80.3 dBA for the prior art twister and 78.3 dBA for the twister having the present mounting means. In these tests, no yarn was used so that a more direct comparison may be made of the machine components. At these overall machine sound levels, a reduction of 2 dBA effected through the use of the present mounting means is a quite substantial one. In the foregoing tests, the tension imparted to the drive tape was 6.14 pounds (2.79 kilograms).

While the invention has been described and defined within the context of pairs of opposing spindle assemblies, it is to be understood that such assemblies having therebetween tape tensioner assemblies of the invention may be separated longitudinal the frame by other pairs of assemblies not having therebetween tape tensioner assemblies, but being conjoined to the pairs having tape tensioner assemblies by a common drive tape, such as in four spindle drives well known and commonly used in the art or even higher numbered spindle drives such as the eight spindle drive shown and described my Merck in U.S. Pat. No. 3,753,344.

Thus, having described a preferred embodiment of the invention, one skilled in the art may immediately think of variations in the contours of elements, types of elements and their construction, materials of construction and means for interconnection which attain the objects aforesaid and fall within the scope of the definitions of the invention as below claimed.

That which is claimed is:

1. In a textile yarn twister machine, having a plurality of spindle assemblies mounted upon rails and in a row therealong on each longitudinal side of said machine, and having drive means for rotationally driving the spindles of said assemblies to form packages of twisted yarn thereon, said drive means comprising a drive motor, a drive shaft from said motor extending longitudinal and intermediate said rows and power transmission interconnections joining said shaft to said assemblies comprising, for a pair of opposing assemblies, a drive drum secured to said shaft for rotation therewith, a plurality of idler pulley wheels intermediate said drum and said assemblies, a continuous drive tape interconnecting said pair of assemblies and entrained on peripheral surfaces of said drum and idlers, and a tape tensioning means to maintain said tape under sufficient tension to transmit power from said drum and through said idlers to said pair of spindle assemblies, the improvement comprising:

resilient mounting means for supportively and resiliently mounting said idlers and tape tensioning means intermediate said pair of opposing spindle assemblies in a stable condition transversely and longitudinally the machine, said mounting means comprising resilient transverse support means for rigidly supporting said idlers and said tape tensioning means, for resiliently interconnecting said opposing spindle rails, and for resiliently separating said idlers and tape tensioning means from said spindle rails, and rigid longitudinal support means for rigidly interconnecting a plurality of said resilient transverse support means in a direction longitudinal said machine, and being spaced away from said spindle rails.

2. An improvement as in claim 1, wherein said resilient transverse support means comprises an elongate rigid member transversely disposed between said spindle rails and a plurality of resilient members each rigidly interconnected to an end of said elongate rigid member and to a spindle rail, to resiliently interconnect said spindle rails, and to resiliently separate said elongate rigid member from said spindle rails.

3. An improvement as in claim 2, wherein said elongate rigid member and said spindle rails are vertically interconnected by said resilient members.

4. An improvement as in claim 3, wherein said resilient members have a body member formed of rubber.

5. An improvement as in claim 3, wherein said resilient members are in the form of springs.

6. An improvement as in claim 3, wherein said mounting means further comprises a plurality of resilient, shock absorbing elements horizontally interposed between and in abutting contact with each of said spindle rails and the corresponding ends of said transverse elongate rigid member.

7. An improvement as in claim 6, wherein said ends of said transverse elongate rigid member include, each, a holding member rigidly connected the body portion of said rigid member, which holding member is in abutting contact with said shock absorbing element to positionally hold it thereat.

8. An improvement as in claim 2, wherein said idlers and tape tensioning means are mounted on and supported by said elongate rigid member.

9. An improvement as in claim 2, wherein said rigid longitudinal support means comprises a plurality of elongate rigid members rigidly interconnected with each and a plurality of said transverse support means' elongate rigid members and extending generally longitudinal said twister.

* * * * *